US006059396A

United States Patent [19]

Choi

[11] Patent Number: 6,059,396

[45] Date of Patent: May 9, 2000

[54] INK-JET PRINTER HAVING A UNITARY PRINTHEAD AND CARRIAGE ASSEMBLY

[75] Inventor: Dong-Ha Choi, Kyungki-do, Rep. of Korea

[73] Assignee: SamSung Electronics Co., Ltd., Suwon, Rep. of Korea

[21] Appl. No.: 08/959,069

[22] Filed: Oct. 28, 1997

[30] Foreign Application Priority Data

Oct. 28, 1996 [KR] Rep. of Korea ..... 96-49296

[51] Int. Cl.[7] ..... B41J 2/175

[52] U.S. Cl. ..... 347/37

[58] Field of Search ..... 347/29, 37, 49, 347/50, 86, 108, 8; 346/139 R

[56] References Cited

U.S. PATENT DOCUMENTS

| | | | |
|---|---|---|---|
| 4,475,116 | 10/1984 | Sicking et al. | 347/86 |
| 4,755,836 | 7/1988 | Ta et al. | 347/49 |
| 4,907,018 | 3/1990 | Pinkerpell et al. | 346/139 R |
| 4,942,408 | 7/1990 | Braun | 347/63 |
| 5,138,342 | 8/1992 | Kurata et al. | 347/50 |
| 5,212,502 | 5/1993 | Bowling | 347/49 |
| 5,216,448 | 6/1993 | Unosawa et al. | 347/49 |
| 5,404,158 | 4/1995 | Carlotta et al. | 347/32 |
| 5,448,274 | 9/1995 | Hirabayashi et al. | 347/86 |
| 5,500,664 | 3/1996 | Suzuki et al. | 347/86 |
| 5,539,436 | 7/1996 | Wilson et al. | 347/37 |
| 5,592,202 | 1/1997 | Erickson | 347/37 |
| 5,629,725 | 5/1997 | Buican | 347/49 |
| 5,671,000 | 9/1997 | Hirabayashi et al. | 347/86 |
| 5,696,541 | 12/1997 | Akahane et al. | 347/8 |
| 5,805,181 | 9/1998 | Tanaka et al. | 347/29 |
| 5,886,721 | 3/1999 | Fujii et al. | 347/87 |

*Primary Examiner*—N. Le
*Assistant Examiner*—Anh T. N. Vo
*Attorney, Agent, or Firm*—Robert E. Bushnell, Esq.

[57] ABSTRACT

An ink-jet printer includes a unitary printhead and carriage assembly supporting a refillable or replaceable ink storage vessel for printing from a reservoir of ink from the ink storage vessel through a printhead comprising a plurality of nozzles according to a print command input received via a printing control cable. A head cap provides access to the printhead and carriage assembly to replace the ink storage vessel when ink is depleted in order to continuously provide a supply of ink without discarding the printhead cartridge.

26 Claims, 5 Drawing Sheets

INK-JET PRINTER HAVING A UNITARY PRINTHEAD AND CARRIAGE ASSEMBLY

CLAIM FOR PRIORITY

This application makes reference to, incorporates the same herein, and claims all benefits accruing under 35 U.S.C. § 119 from an application for INK-JET PRINTER HAVING A UNIFIED CARRIAGE AND PRINT HEAD ELEMENT earlier filed in the Korean Industrial Property Office on the 28th of Oct. 1997, and there duly assigned Ser. No. 49296/1996, a copy of which application is annexed hereto.

BACKGROUND OF THE INVENTION

1. Technical Field

The present invention relates to an ink-jet printer and, more particularly, to an ink-jet printer having an ink cartridge supporting a printhead integrally formed with a carriage assembly.

2. Related Art

Ink-jet printers are generally popular because they offer high printing speed, low noise, easy color printing, simply construction and low price. The concepts and operational principles of ink jet printers are well described, for example, in U.S. Pat. No. 4,475,116 for Ink Printer Equipped With An Ink Printing Head And Intermediate Ink Container Disposed On A Movable Carriage issued to Sicking et al., U.S. Pat. No. 4,755,836 for Printhead Cartridge And Carriage Assembly issued to Ta et al., U.S. Pat. No. 4,942,408 for Bubble Ink Jet Print Head And Cartridge Construction And Fabrication Method issued to Braun, U.S. Pat. No. 4,907,018 for Printhead-Carriage Alignment And Electrical Interconnect Lock-in Mechanism issued to Pinkerpell et al., U.S. Pat. No. 5,138,342 for Ink Jet Cartridge And Ink Jet Recording Apparatus Employing The Same issued to Kurata et al., U.S. Pat. No. 5,212,502 for Ink Jet Print Head Mounting Mechanism issued to Bowling, U.S. Pat. No. 5,216,448 for Ink Jet Recording Head Carriage And An Apparatus With Same issued to Unosawa et al., U.S. Pat. No. 5,404,158 for Ink Jet Printer Maintenance System issued to Carlotta et al., U.S. Pat. No. 5,448,274 for Ink Jet Recording Apparatus And Carriage Mechanism Therefor issued to Hirabayashi et al., U.S. Pat. No. 5,539,436 for Modular Carriage Assembly For An Inkjet Printer issued to Wilson et al., and U.S. Pat. No. 5,629,725 for Carriage Mount For An Ink Jet Cartridge issued to Buican.

In general, an ink jet cartridge is detachably mounted on a carriage assembly which supports a printhead, and traverses the printhead across the width of a recording medium in a line recording operation along a guide shaft for printing an image or character on the recording medium. An ink jet cartridge is typically constructed in and unitary, detachable cartridge which includes a printhead comprising a plurality of nozzles in the form of a nozzle plate mounted on one end, and an ink container containing a reservoir of ink, drop generating structures and electrically connections adapted for electrically coupling the printhead to the ink jet printer which provides drop generating energy in response to information signals generated by the ink jet printer. The principle behind this type of ink jet printer is the generation of a thermal pressure wave in the ink container and subsequent emission of ink droplets from the ink container through a plurality of nozzles arranged vertically at a front end of the printhead provided with the ink jet cartridge. The thermal pressure wave is generated by selected heating elements installed in the nozzles, which heat the ink contained within the nozzles until the ink is ejected through an ejection orifice of the nozzles to produce a flying droplet of the ink. The droplet is deposited on the recording medium so that a desired character and image can be formed.

When ink in the ink container is used up, however, the entire ink jet cartridge including the printhead needs to be replaced. This is required because the ink jet cartridge is typically constructed in a unitary structure regardless of whether such an ink jet cartridge involves a relatively large difference between the period in which the ink in the ink container is used up and the service life of the printhead. Although there are recent proposed constructions of an ink jet cartridge in which the ink container is detachably mounted to a printhead so as to permit replacement of the ink container and the printhead separately at different times as disclosed, for example, in U.S. Pat. No. 5,500,664 for Ink Jet Recording Apparatus And Detachably Mountable Ink Jet Cartridge issued to Suzuki et al., and U.S. Pat. No. 5,671,000 for Ink Jet Cartridge With Separable Ink Tank And Recording Head issued to Hirabyashi et al., the ink jet cartridge still needs to be taken out of the ink jet printer for replacement of the entire ink jet cartridge or an individual part of the ink jet cartridge.

A contemporary ink jet cartridge that is detachably mounted on carriage assembly as I have generally described, however, has several drawbacks. For example, the indirect connection of the computer interface with the printhead, i.e., between primary and secondary printing control cables, may result in a poor or unreliable connection and tends to cause malfunction. Such a computer connection also requires additional components and assembly time, which increases production cost. In addition, since the ink jet cartridge is a disposable item which includes printhead nozzles and secondary printing control cables, the entire cartridge must be discarded when ink supply is depleted, regardless of the condition of the nozzles or the associated cables and contacts, all of which tend to have long lifetimes when compared to the ink supply. This is both wasteful and cost-prohibitive.

SUMMARY OF THE INVENTION

Accordingly, it is therefore an object of the present invention to provide an ink-jet printer having an integrated printhead and carriage assembly with a unitary structure.

It is also an object to provide an ink-jet printer having a unitary printhead and carriage assembly which supports a refillable and replaceable ink container for supplying ink.

It is another object to provide an ink-jet printer having a unitary printhead and carriage assembly to a printhead directly connected with computer interface via a single printing control cable.

These and other objects of the present invention can be achieved by an ink-jet printer having an integrated printhead and carriage assembly constructed of a housing for housing therein a replaceable and detachable ink storage vessel containing a reservoir of ink. A head cap is pivotally connected at the top of the housing to rotate between a closed position and an open position for permitting access to replace the ink storage vessel contained in the housing. A printhead portion comprised of a plurality of nozzles extends from the bottom of the housing for ejecting ink from the ink storage vessel onto a recording medium during a printing operation according to a print command input via a printing control cable. At least one sliding arm extends from one side of the housing and has a generally circular bore defined therein for sliding on a guide shaft extending across a width of said recording medium during the printing operation; and at least one belt coupling member is disposed adjacent to the sliding arm extending from the one side of the housing for connection to a timing belt to guide the housing across the width of the recording medium during the printing operation. The head cap allows the user to manually replace the ink storage vessel when depleted of ink in order to provide a continuous resupply of ink without having to discard an entire printhead.

The nozzles of the printhead portion are directly connected to the printing control cable which is connected to a computer interface. The head cap is joined to the unitary printhead and carriage assembly by means of a hinge pivoting on a hinge pin thereof, for permitting access to replace the ink storage vessel, and has a locking member which engages with a corresponding locking groove. Plural sealing ribs are formed on the bottom of the ink storage vessel to direct the flow of ink toward the nozzles. Pairs of sliding arms and belt coupling members are integrally formed on the rear of the housing for guiding the housing across the width of the recording medium during the printing operation.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
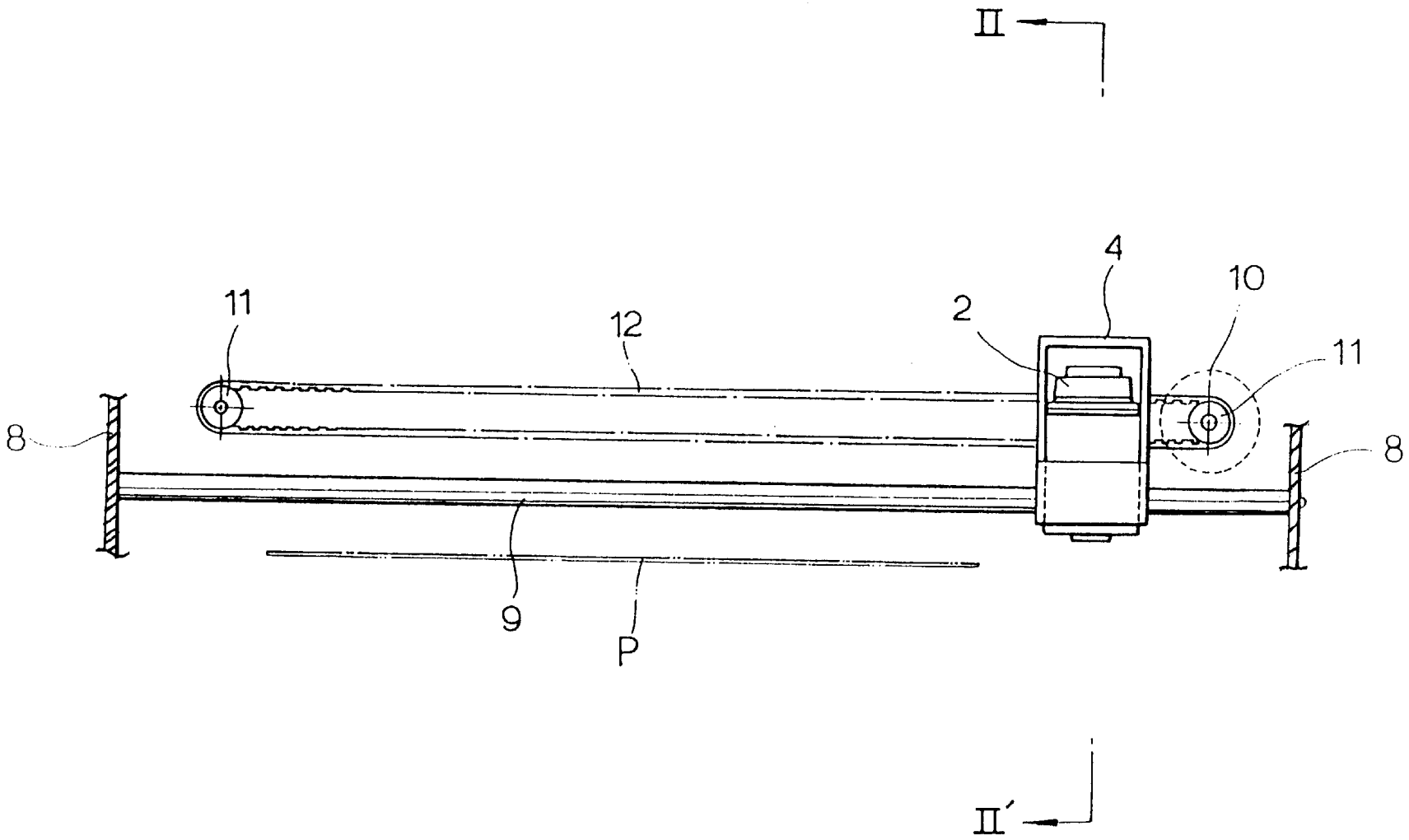
FIG. 1 is a front view of a typical ink-jet printer.

Refer now to the drawings and particularly to FIG. 1, which illustrates a principal structure of an ink-jet printer. The ink-jet printer includes a carriage assembly 4 which slides laterally along a guide shaft 9 mounted between adjacent structures of a frame 8 of the printer. The carriage assembly 4 includes a carriage body where an ink cartridge 2 supporting a printhead is installed, a sliding arm for sliding on the guide shaft 9, and a holder for connection to a timing belt 12 which is turned by a timing pulley 11 in response to rotation of a stepping motor 10. The ink cartridge 2 is typically constructed as a unitary, detachable cartridge of a reservoir of ink that is installed in the carriage assembly 4. The ink cartridge 2 includes a printhead 2b (see FIG. 2) comprising a plurality of nozzles in the form of a nozzle plate mounted on one end that is fluidically associated with the reservoir of ink.

Figure 2:
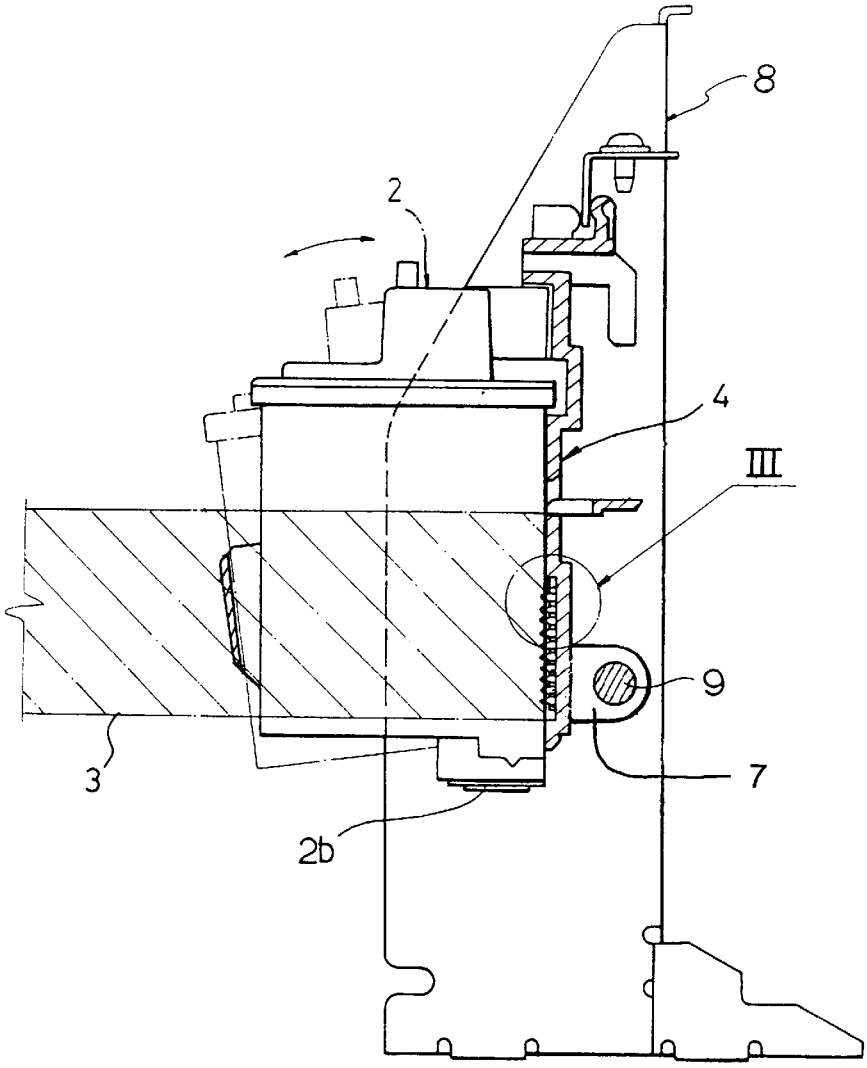
FIG. 2 is a cross-sectional view of an ink-jet cartridge detachably mounted on a carriage assembly along line II–II' of the ink-jet printer of FIG. 1.
Figure 3:
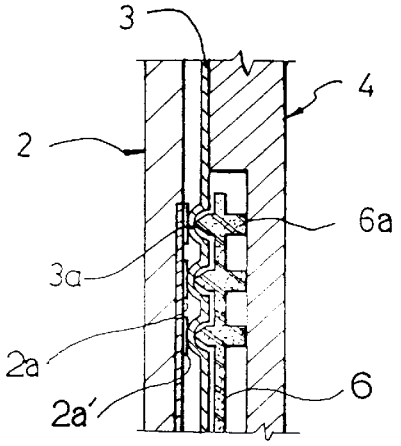
FIG. 3 is an enlarged view of area III of FIG. 2.

FIGS. 2 and 3 illustrate a cross-sectional view of the ink-jet cartridge detachably mounted on the carriage assembly along line II–II' of the ink-jet printer of FIG. 1. As shown in FIG. 2, a primary printing control cable 3 for supplying print commands from a computer interface (not shown) to the ink cartridge 2 is attached at one end to the carriage assembly 4 and is provided with a plurality of dimples 3*a* for electrical contact with the printhead 2*b*. Attached to the ink cartridge 2, a secondary printing control cable 2*a* having a plurality of electrical contacts 2*a*' corresponding to the dimples 3*a* is provided to carry the print commands to a plurality of nozzles 2*b* disposed on the bottom of the ink cartridge 2. A rubber contact 6 having a plurality of supports 6*a* is installed in the inner rear surface of the carriage assembly 4, for establishing firm elastic contact between the dimples 3*a* of the primary printing control cable 3 and the electrical contacts 2*a*' of the secondary printing control cable 2*a* which is fixed to the rear surface of the ink cartridge 2.

The contemporary ink jet cartridge that is detachably mounted on carriage assembly as I have generally described earlier, has several drawbacks. For example, the indirect connection of the computer interface with the printhead 2*b*, i.e., between primary printing control cable 3 and secondary printing control cable 2*a*, may result in a poor or unreliable connection and tends to cause malfunction. Such a computer connection also requires additional components and assembly time, which increases production cost. In addition, since the ink jet cartridge is a disposable item which includes printhead nozzles 2*b* and secondary printing control cable 2*a*, the entire cartridge must be discarded when the ink supply is depleted, regardless of the condition of the nozzles 2*b* or the associated cables 2*a* and 3 and contacts 2*a* and 3*a*, all of which tend to have long lifetimes when compared to the ink supply. This is both wasteful and cost-prohibitive.

Figure 4:
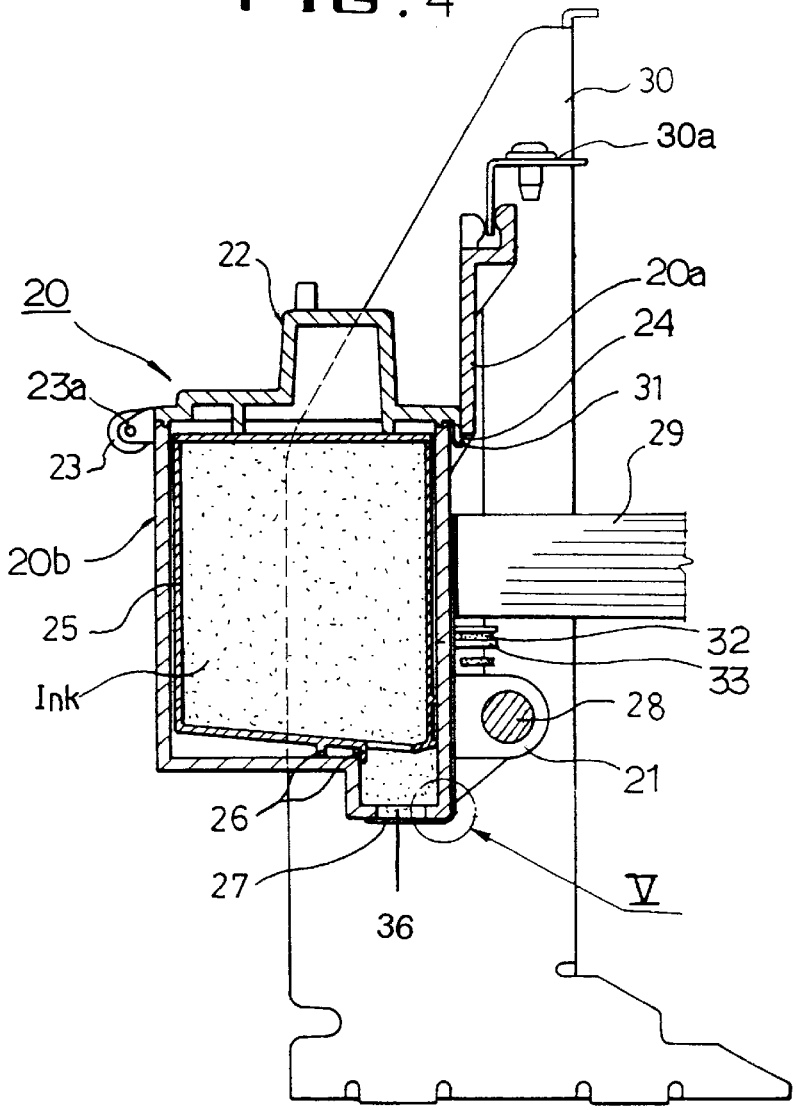
FIG. 4 is a cross-sectional view of an integrated printhead and carriage assembly installed in an ink-jet printer constructed according to the principles of the present invention.

Attention is directed now to FIG. 4, which illustrates an ink-jet printer having a unitary printhead and carriage assembly supporting a refillable or replaceable ink storage vessel as constructed according to the principles of the present invention. As shown in FIG. 4, the unitary printhead and carriage assembly 20 is formed by a carriage portion 20*a* extending from a printhead body 20*b* which supports therein a refillable or a replaceable ink storage vessel 25, toward a securing and guiding mechanism 30*a* located on frame 30 of the printer to assure accurate movement of assembly 20 in the ink-jet printer. The assembly 20 further comprises a belt coupling member 33 extending from a back side of the printhead body 20*b* for connection with a timing belt 32, and a sliding arm 21 extending from a back side of the printhead body 20*b* and having a circular bore formed therein so as to slidably and rotatably fit around a guide shaft 28 of a single rail structure 30 for allowing the unitary printhead and carriage assembly 20 to slide across the width of a recording medium in a line printing operation for printing an image or character thereon via a printhead 27 comprising a plurality of nozzles in the form of a nozzle plate mounted on a bottom portion of the printhead body 20*b* and fluidically associated with the reservoir of ink in the replaceable ink storage vessel 25. The printhead body 20*b* also has a camping groove 36 at the bottom portion for permitting sealing of the nozzles of the printhead 27 when the unitary printhead and carriage assembly 20 is at a home position. A deflector guide (not shown) may be mounted adjacent to the printhead 27 on the lower portion of the camping groove 36 to deflect recording media from undesirably interfering with the operation of the printhead 27.

The printhead body 20*b* further includes a head cap 22 pivotally connected to the top side of the printhead body 20*b* by means of a hinge 23 which pivots about a hinge pin 23*a* from a closed position to an open position for allowing a user to manually refill or replace the ink storage vessel 25 contained in the printhead body 20*b*. The head cap 22 has a locking member 31 at an opposite end from the hinge 23 which latches the head cap 22 onto the printhead body 20*b*, when the head cap 22 is in a closed position to secure the detachable ink storage vessel 25 in the printhead body 20*b*. The ink storage vessel 25 has sealing ribs 26 which are formed at the bottom portion for directing ink to the nozzles of printhead 27 via camping groove 36 when the head cap 22 is in the closed position to secure the vessel 25 in the printhead body 20*b*.

Figure 5:
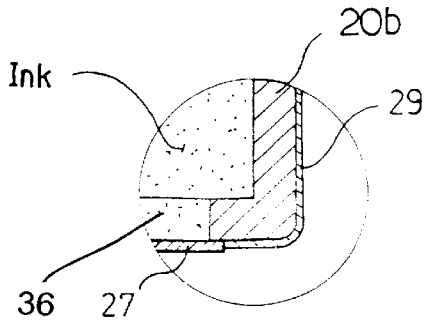
FIG. 5 is an enlarged view of area V of FIG. 4.

The carriage portion 20*a* extending from the printhead body 20*b* provides a locking groove 24 for engaging with a locking member 31, when the head cap 22 is in the closed position to secure the vessel 25 in the printhead body 20*b*. The printhead 27 comprised of a plurality of nozzles is electrically connected directly with a printing control cable 29, as shown in FIG. 5 which is an enlarged view of area V of FIG. 4.

Figure 6:
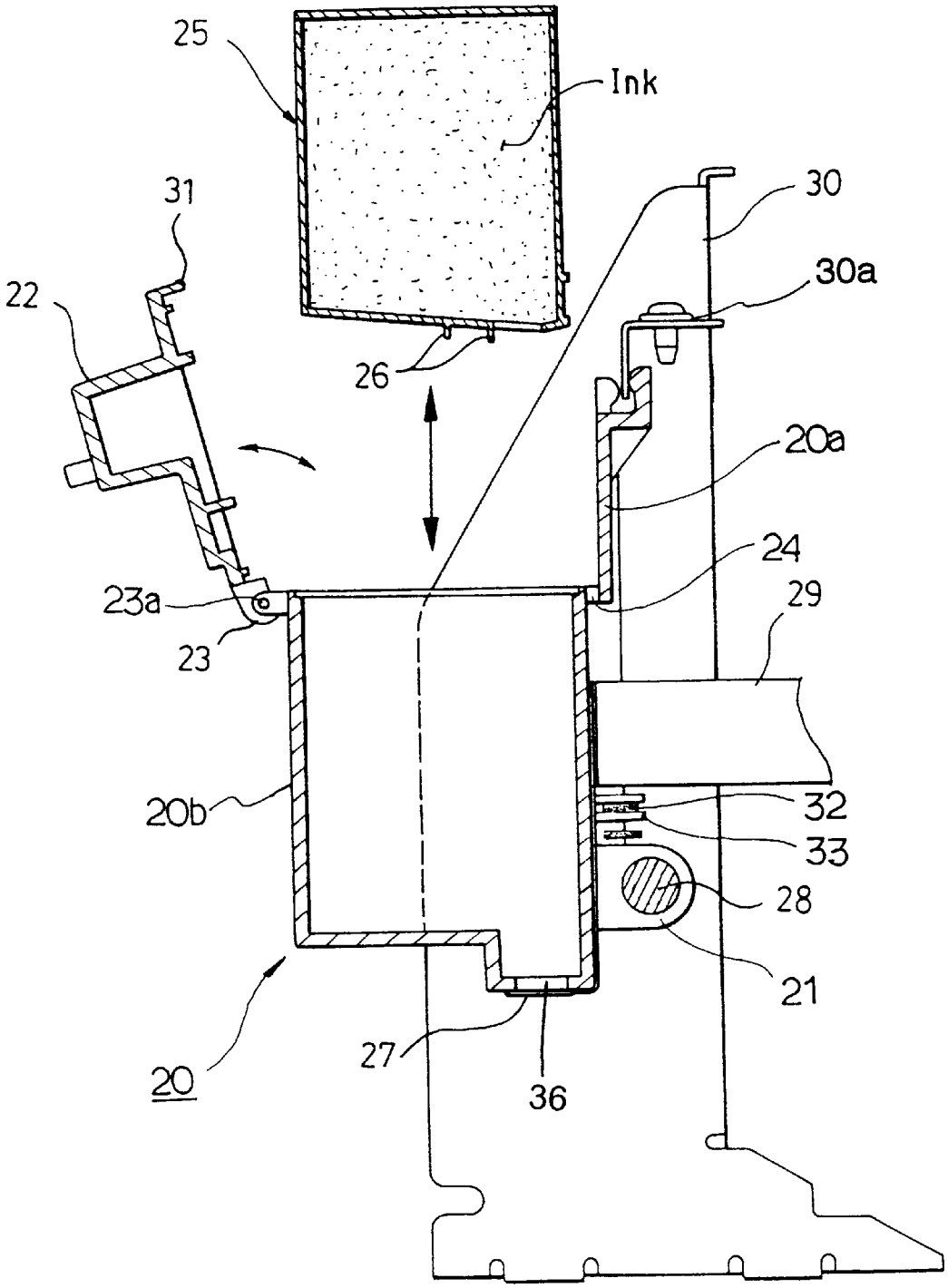
FIG. 6 is a cross-sectional view of the integrated printhead and carriage assembly installed in an ink-jet printer when replacing an ink storage vessel contained therein according to the principles of the present invention.

FIG. 6 illustrates a cross-sectional view of the integrated printhead and carriage assembly 20 installed in an ink-jet printer when replacing the ink storage vessel 25 according to the principles of the present invention. That is, when the ink supply is depleted, the lock member 31 is released and the head cap 22 is opened to allow the user to remove the ink storage vessel 25 for ink refilling or replacement. After ink refilling or vessel replacement, the locking member 31 is seated (locked) in the locking groove 24 of the carriage portion 20*a* by pressing down on the head cap 22 firmly. As a result, new ink supply is provided while the original printhead remains for use.

Figure 7:
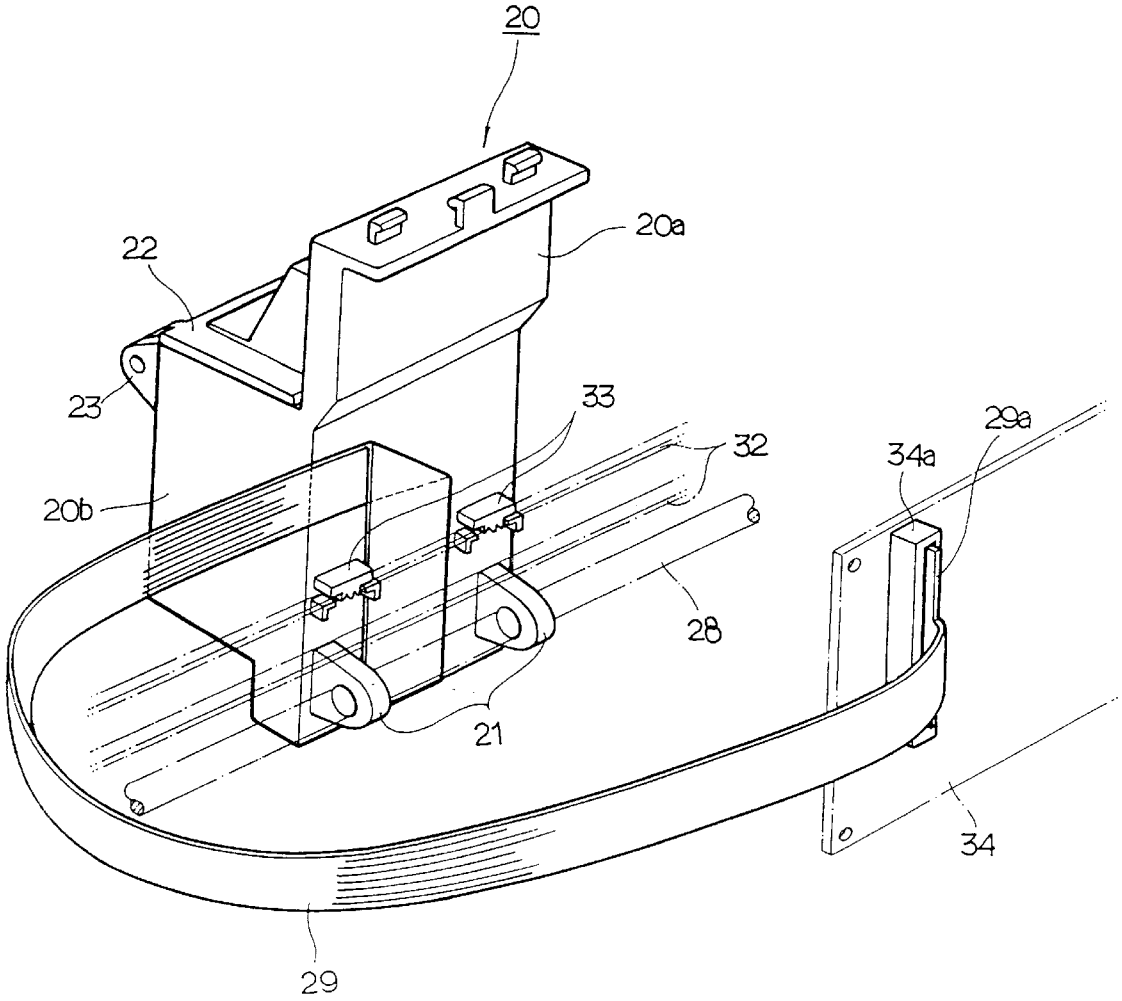
FIG. 7 is a rear perspective view of the integrated printhead and carriage assembly installed in an ink-jet printer according to the principles of the present invention.

FIG. 7 illustrates the installation of the unitary printhead and carriage assembly 20 in the ink-jet printer according to the principles of the present invention. The unitary printhead and carriage assembly 20 has a pair of sliding arms 21 integrally formed on the back side of the printhead body 20*b* for sliding along a guide shaft 28, and belt coupling members 33 integrally formed over the sliding arms for connection to a timing belt 32. At the opposite end of the printing control cable 29 with respect to the plurality of nozzles 27, a male connector 29*a* connects to a female connector 34*a* of a printed circuit board 34 (computer interface).

As described above, the present invention advantageously provides a unitary printer and carriage assembly supporting therein a refillable or replaceable ink storage vessel without having to discard an entire printhead in order to reduce production cost, simplify the manufacturing process and minimize maintenance cost. In addition, since the nozzles are directly connected to the printing control cable, print commands are received at the nozzles directly, without the need for a dimpled printing control cable, a secondary print control cable or a rubber contact, via a single printing control cable, thus assuring reliable electrical connection and simplified construction. Since the printhead is no longer disposable, the life span of the cartridge is enhanced with higher reliability.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A unitary printhead and carriage assembly of a printer, comprising:

a housing for housing therein a replaceable and detachable ink container containing a reservoir of ink;

a cap pivotally connected at a top of said housing to rotate between a closed position and an open position for permitting access to replace the ink container contained in said housing;

a printhead body extending from a bottom of said housing and comprising an ink ejection outlet for ejecting ink from the ink container onto a recording medium during a printing operation according to a print command input received via a printing control cable; and carriage means extending from one side of said housing for guiding said housing across a width of said recording medium during said printing operation;

wherein said ink container includes sealing ribs formed on a bottom thereof and extending between said ink container and said housing for directing flow of ink toward said ink ejection outlet.

2. The unitary printhead and carriage assembly of claim 1, further comprising a camping groove formed on said printhead body adjacent to the ink ejection outlet, wherein said sealing ribs direct the flow of ink to said ink ejection outlet via said camping groove.

3. The unitary printhead and carriage assembly of claim 1, said carriage means comprising:

at least one sliding arm extending from said one side of said housing and having a generally circular bore formed therein for receiving a guide shaft extending across the width of said recording medium, said at least one sliding arm sliding along said guide shaft during said printing operation; and at least one belt coupling member disposed adjacent to said at least one sliding arm and extending from said one side of said housing for connection to a timing belt to guide said housing across the width of said recording medium during said printing operation.

4. The unitary printhead and carriage assembly of claim 3, further comprising a camping groove formed on said printhead body for permitting sealing of the ink ejection outlet when the unitary printhead and carriage assembly is at a home position.

5. The unitary printhead and carriage assembly of claim 3, further comprising a printed circuit board serving as a computer interface for generating the print command input to the printhead body via said printing control cable for printing images on said recording medium by ejecting ink from the ink container, via said ink ejection outlet, onto said recording medium during said printing operation.

6. The unitary printhead and carriage assembly of claim 3, said cap pivoting about the top of said housing by means of a hinge so as to rotate between said closed position and said open position for permitting access to replace the ink container contained in said housing when the ink container is depleted of ink.

7. The unitary printhead and carriage assembly of claim 6, further comprising locking means formed opposite said hinge for locking said cap when said cap is in said closed position.

8. The unitary printhead and carriage assembly of claim 3, said ink ejection outlet of said printhead body being electrically connected directly to the printing control cable.

9. The unitary printhead and carriage assembly of claim 8, said printing control cable comprising a single electrical connection between the ink ejection outlet and a computer interface.

10. A unitary printhead and carriage assembly of a printer, comprising:

a housing for housing therein a replaceable and detachable ink container containing a reservoir of ink;

a cap pivotally connected at a top of said housing to rotate between a closed position and an open position for permitting access to replace the ink container contained in said housing;

a printhead body extending from a bottom of said housing and comprising an ink ejection outlet for ejecting ink from the ink container onto a recording medium during a printing operation according to a print command input received via a printing control cable; and carriage means extending from one side of said housing for guiding said housing across a width of said recording medium during said printing operation;

said assembly further comprising a carriage portion extending from the top of said housing and having means for securing accurate movement across the width of said recording medium during said printing operation.

11. The unitary printhead and carriage assembly of claim 10, said ink container having sealing ribs formed on a bottom thereof to direct flow of ink toward said ink ejection outlet.

12. The unitary printhead and carriage assembly of claim 10, said cap pivoting about the top of said housing by means of a hinge so as to rotate between said closed position and said open position for permitting access to replace the ink container contained in said housing when the ink container is depleted of ink.

13. The unitary printhead and carriage assembly of claim 12, wherein said carriage portion extends from a portion of said top of said housing opposite to a further portion of said housing at which said hinge is located.

14. A printer which includes a unitary printhead and carriage assembly, comprising:

a guide shaft extending across a width of a recording medium; and a timing belt driven by a main motor for guiding said unitary printhead and carriage assembly along said guide shaft;

said unitary printhead and carriage assembly comprising:

a housing for housing therein a replaceable and detachable ink container containing a reservoir of ink;

a cap pivotally connected at a top of said housing to rotate between a closed position and an open position for permitting access to replace the ink container contained in said housing;

a printhead body extending from a bottom of said housing and comprising a plurality of nozzles in the form of a nozzle plate for ejecting ink from the ink container onto a recording medium during a printing operation according to a print command input received via a printing control cable;

at least one sliding arm extending from one side of said housing and having a generally circular bore formed therein for receiving said guide shaft, said at least one sliding arm sliding along said guide shaft during said printing operation; and at least one belt coupling member disposed adjacent to said at least one sliding arm and extending from the one side of said housing for connection to said timing belt to guide said housing across the width of said recording medium during said printing operations;

wherein said ink container includes sealing ribs formed on a bottom thereof and extending between said ink container and said housing for directing flow of ink toward said ink ejection outlet.

15. The printer of claim 14, further comprising a camping groove formed on said printhead body for permitting sealing of the ink ejection outlet when the unitary printhead and carriage assembly is at a home position.

16. The printer of claim 14, further comprising a printed circuit board serving as a computer interface for generating the print command input to the printhead body via said printing control cable for printing images on said recording medium by ejecting ink from the ink container, via said nozzles, onto said recording medium during said printing operation.

17. The printer of claim 14, said ink ejection outlet of said printhead body being electrically connected directly to the printing control cable so as to form a single electrical connection between the nozzles and a computer interface.

18. The printer of claim 14, wherein said printhead body comprises an ink ejection outlet, said printer further comprising a camping groove formed on said printhead body adjacent to the ink ejection outlet, wherein said sealing ribs direct the flow of ink to said ink ejection outlet via said camping groove.

19. The printer of claim 14, said cap pivoting about the top of said housing by means of a hinge so as to rotate between said closed position and said open position for permitting access to replace the ink container contained in said housing when the ink container is depleted of ink.

20. The printer of claim 19, further comprising locking means formed opposite said hinge for locking said cap when said cap is in said closed position.

21. The printer of claim 14, said ink ejection outlet of said printhead body being electrically connected directly to the printing control cable.

22. The printer of claim 21, said printing control cable comprising a single electrical connection between the nozzles and a computer interface.

23. A printer which includes a unitary printhead and carriage assembly, comprising:

a guide shaft extending across a width of a recording medium; and a timing belt driven by a main motor for guiding said unitary printhead and carriage assembly along said guide shaft;

said unitary printhead and carriage assembly comprising:

a housing for housing therein a replaceable and detachable ink container containing a reservoir of ink;

a cap pivotally connected at a top of said housing to rotate between a closed position and an open position for permitting access to replace the ink container contained in said housing;

a printhead body extending from a bottom of said housing and comprising a plurality of nozzles in the form of a nozzle plate for ejecting ink from the ink container onto a recording medium during a printing operation according to a print command input received via a printing control cable;

at least one sliding arm extending from one side of said housing and having a generally circular bore formed therein for receiving said guide shaft, said at least one sliding arm sliding along said guide shaft during said printing operation; and at least one belt coupling member disposed adjacent to said at least one sliding arm and extending from the one side of said housing for connection to said timing belt to guide said housing across the width of said recording medium during said printing operation;

said printer further comprising a carriage portion extending from the top of said housing and having means for securing accurate movement across the width of said recording medium during said printing operation.

24. The printer of claim 23, said ink container having sealing ribs formed on a bottom thereof to direct flow of ink toward said nozzles.

25. The printer of claim 23, said cap pivoting about the top of said housing by means of a hinge so as to rotate between said closed position and said open position for permitting access to replace the ink container contained in said housing when the ink container is depleted of ink.

26. The printer of claim 25, wherein said carriage portion extends from a portion of said top of said housing opposite to a further portion of said housing at which said hinge is located.

* * * * *